US005241274A

United States Patent [19]

Williams

[11] Patent Number: 5,241,274

[45] Date of Patent: Aug. 31, 1993

[54] ON-BOARD INTERNAL COMBUSTION ENGINE SPARK PLUG EFFICIENCY VISUAL DISPLAY

[76] Inventor: Bill J. Williams, Rte. 6, Box 566, Claremore, Okla. 74017

[21] Appl. No.: 545,331

[22] Filed: Jun. 26, 1990

[51] Int. Cl.[5] ..... F02P 17/00

[52] U.S. Cl. ..... 324/395

[58] Field of Search ..... 324/395, 393, 399, 96, 324/556

[56] References Cited

U.S. PATENT DOCUMENTS

| | | | |
|---|---|---|---|
| 4,032,843 | 6/1977 | Loucks | 324/96 |
| 4,547,734 | 10/1985 | Spaude | 324/395 |
| 4,825,167 | 4/1989 | Bayba | 324/393 X |
| 4,902,978 | 2/1990 | Horigan | 324/556 |

FOREIGN PATENT DOCUMENTS

| | | | |
|---|---|---|---|
| 2912142 | 10/1980 | Fed. Rep. of Germany | 324/395 |

*Primary Examiner*—Kenneth A. Wieder

*Attorney, Agent, or Firm*—Head & Johnson

[57] ABSTRACT

On-board apparatus for visually indicating the efficiency of the spark plugs and ignition wires of an internal combustion engine includes a capacitive clamp attached to the insulated ignition wire of each spark plug of the engine, preferably as close to the spark plug as possible. The current derived by the capacitive clamp is fed through a knock-down resistor to reduce the voltage fed to a conditioning circuit. The conditioning circuit provides a positive pulse substantially proportionate to the intensity of the signal through the conditioning circuit. The resulting signal is then fed to a time delay circuit to provide a relatively smooth signal to a bar graph. The time delay circuit includes high and low sensitivity modes for user selection to generally monitor system efficiency or to detect misfires. An adjustable gain circuit allows the bar graph to be calibrated to operate at a preselected level when the engine idles. The system may optionally include a bar graph test circuit which simultaneously imposes a test voltage to the bar graph of all the spark plugs to permit the operator to determine whether variations from normal bar graph readings are caused by the ignition system or by the bar graph.

1 Claim, 2 Drawing Sheets

Fig. 1
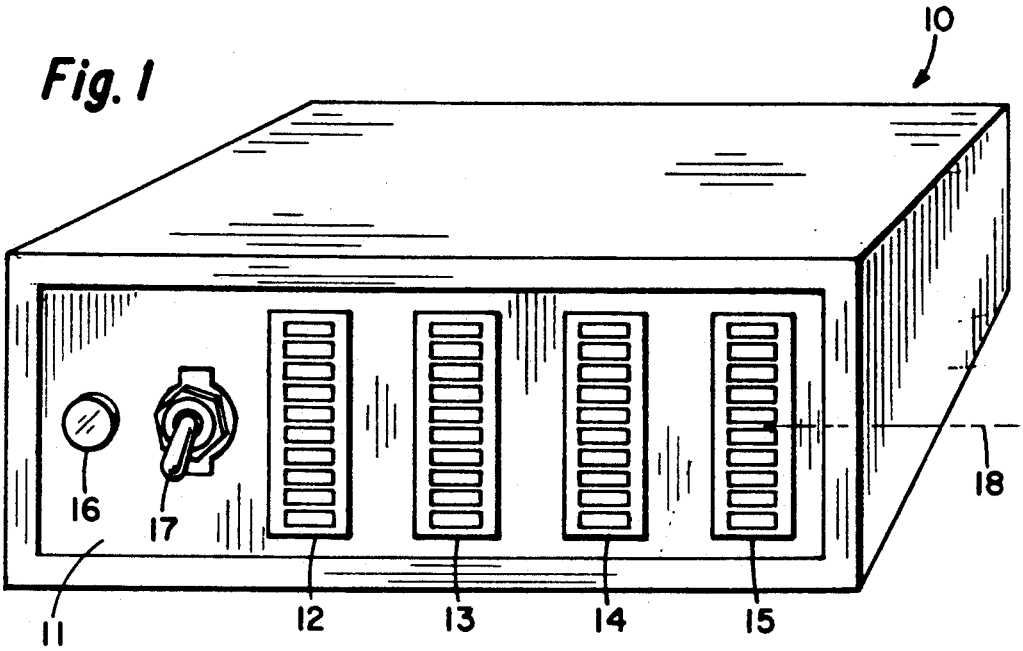
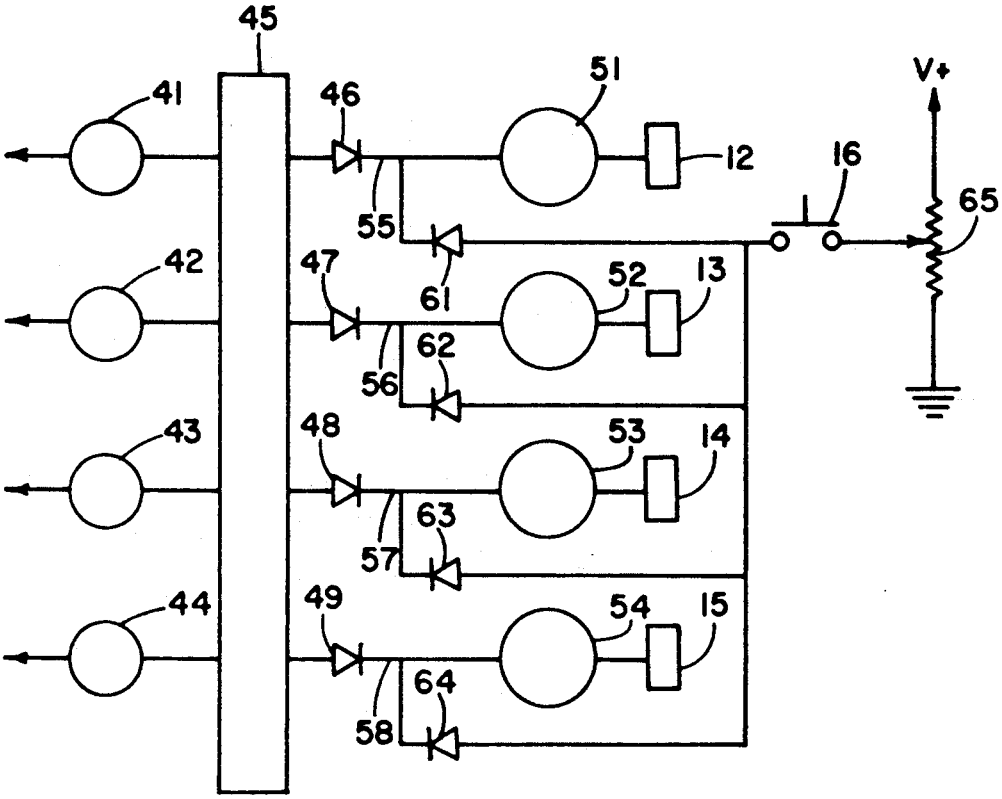
Fig. 3

ON-BOARD INTERNAL COMBUSTION ENGINE SPARK PLUG EFFICIENCY VISUAL DISPLAY

BACKGROUND OF THE INVENTION

This invention relates generally to ignition systems for internal combustion engines and more particularly concerns visual display of the operational efficiency of spark plugs and ignition wires associated with an internal combustion engine for continuous observation by the vehicle operator.

Various types of apparata have been devised for the monitoring of spark plug operation, generally falling into one of two classifications.

The first classification includes apparata intended to be advisory to a vehicle operator, normally by providing light bulb indicia of the operation of the spark plugs by use of a multiplicity of light bulbs, one associated with each spark plug. The current to each light bulb is derived directly from a capacitive or inductive coupling to the ignition wire of its respective spark plug. Since the current in the coupling circuit varies in response to the current in the ignition wire, the light intensity of each bulb is somewhat indicative of the efficiency of its related spark plug and ignition wire. However, due to the rapid variations in ignition wire pulses as well as external sources affecting the magnitude of the current in the coupling circuit, variations in light intensity of such devices is not truly indicative of system efficiency. Therefore, such apparata are generally suitable only for on/off indication rather than efficiency.

The other classification includes apparata devised for diagnostic analysis of ignition systems rather than for operator use. Such devices are designed generally not for light bulb indication but rather for metering or oscillographic representation of the ignition system electrical components. Such systems monitor individual spark plugs with sophisticated equipment far exceeding the needs of most vehicle operators.

It is, therefore, an object of this invention to provide an apparatus useful to visually display the efficiency of the spark plugs and ignition wires of an internal combustion engine to a vehicle operator. Another object of the invention is to provide a visual display for the operator which allows evaluation of individual spark plug efficiency by sequential visual comparison of side-by-side indicia representative of the efficiency of each of the spark plugs of the system. Accordingly, it is an object of the invention to provide simultaneous bar graph displays of all of the spark plugs of the system. It is also an object of the invention to provide a bar graph display which permits calibration of the bar graphs such that the bar graph levels may be coordinated during engine idle when all plugs are operating at maximum efficiency so as to provide a visual point of comparison for the operator.

SUMMARY OF THE INVENTION

In accordance with the invention, an on-board apparatus for visually indicating the efficiency of the spark plugs and ignition wires of an internal combustion engine includes a capacitive clamp attached to the insulated ignition wire of each spark plug of the engine, preferably as close to the spark plug as possible. The current derived by the capacitive clamp is fed through a knock-down resistor to reduce the voltage fed to a conditioning circuit. The conditioning circuit provides a positive pulse substantially proportionate to the intensity of the signal through the conditioning circuit. The resulting signal is then fed to a time delay circuit to provide a relatively smooth signal to a bar graph. The time delay circuit includes high and low sensitivity modes for user selection to generally monitor system efficiency or to detect misfires. An adjustable gain circuit allows the bar graph to be calibrated to operate at a preselected level when the engine idles. The system may optionally include a bar graph test circuit which simultaneously imposes a test voltage to the bar graph of all the spark plugs to permit the operator to determine whether variations from normal bar graph readings are caused by the ignition system or by the bar graph.

BRIEF DESCRIPTION OF THE DRAWINGS

Other objects and advantages of the invention will become apparent upon reading the following detailed description and upon reference to the drawings in which:

FIG. 1 is a perspective view of the visual display console of the present invention illustrating its appearance during the normal operation of the vehicle ignition system;

FIG. 3 is a block diagram illustrating the application of the circuitry of FIG. 2 in relation to a four cylinder engine and further including a visual display test circuit.

Figure 2:
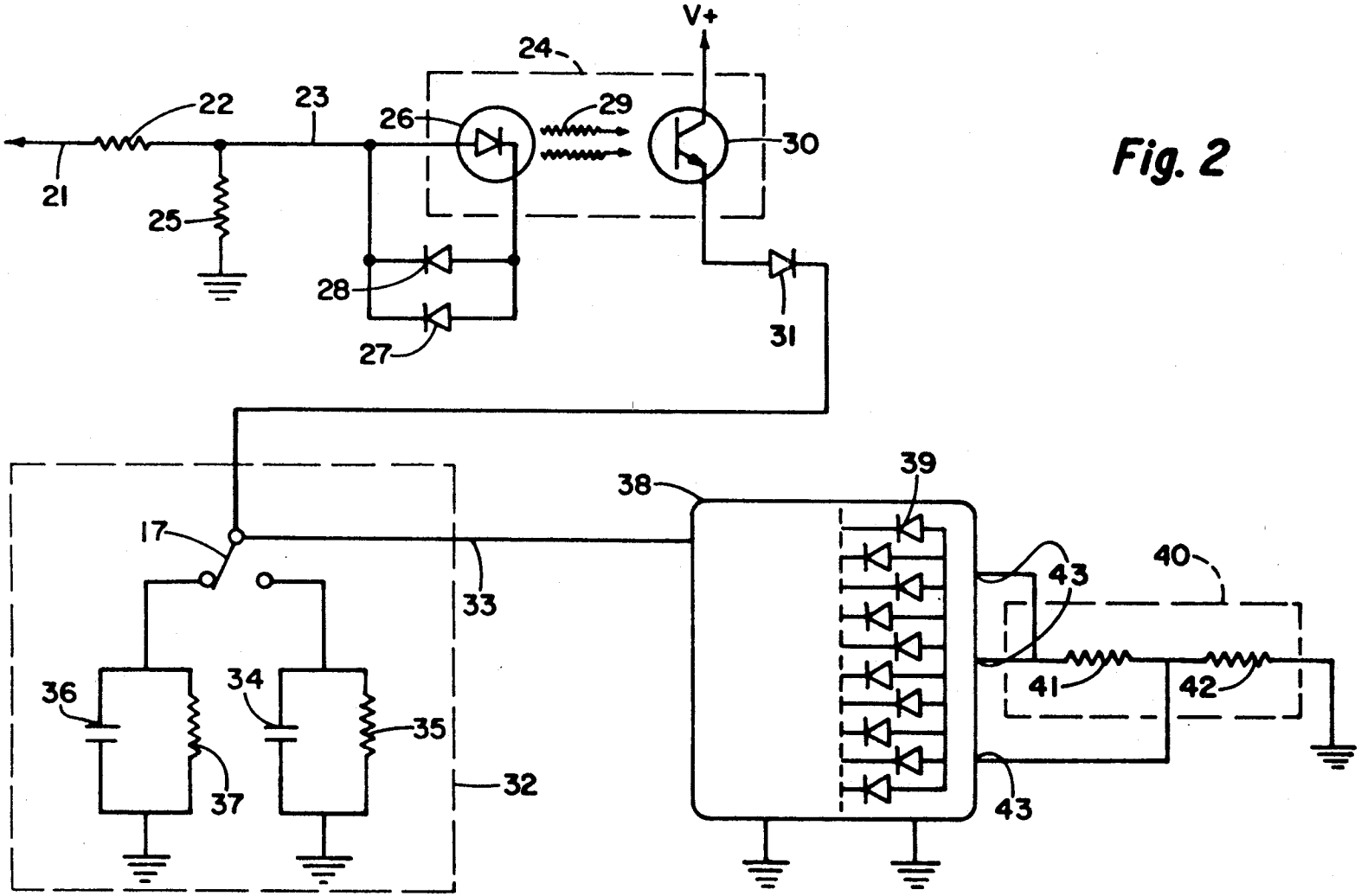
FIG. 2 is a schematic diagram illustrating the control circuitry associated with a single spark plug.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

FIG. 1 illustrates a console 10 which will be mounted in an appropriate location on a vehicle dashboard or display panel (not shown). As shown, the front face 11 of the display panel 10 is illustrated for use in conjunction with a four cylinder internal combustion engine and therefore includes four vertical bar graphs 12, 13, 14 and 15 arranged side-by-side and divided into a number of increments. Also displayed is a test switch 16 accessible to the operator to permit detection of any malfunction in the bar graphs and a toggle switch 17 which enables the operator to choose between two modes of operation as will be hereinafter explained.

Each of the bar graphs is operated by an input signal derived from a circuit illustrated in FIG. 2. A capacitive clip (not shown) grips the insulated ignition wire (not shown) leading to a spark plug (not shown) at a point as close to the spark plug as possible. The capacitive clip derives a current which is proportionately responsive to the current in its related ignition wire. The current is fed through a knock-down resistor 22 which reduces the voltage to a preconditioning circuit. The input current is fed from the capacitive clip via a conductor 21 to the knock-down resistor 22. This resistor 22 is connected by another conductor 23 to the conditioning circuit 24 and also connected to ground via a grounding resistor 25. The input conductor 23 to the conditioning circuit 24 is connected to the anode of a light emitting diode 26. The cathode of the light emitting diode 26 is preferably connected to silicone 27 and germanium 28 diodes connected in parallel and back to the input conductor 23 to further protect the light emitting diode 26. Light 29 emitted by the light emitting diode 26 in response to the input current is sensed by a photo transistor 30 which has its collector connected to a biasing voltage V+ and has its emitter connected to another diode 31. Preferably, the light emitting diode 26, photo transistor 30 and the silicone and germanium diodes 27 and 28 will be incorporated into one or more integrated chips 45 having discrete channels, one channel for each of the cylinders of the four cylinder engine. The output of the photo transistor emitter is connected through the diode 31 to a user selectable time delay circuit 32 which will smooth or average the signal. The time delay circuit 32 includes high and low sensitivity modes selectable by the toggle switch 17 or other suitable switching means on the front of the console 10. The low sensitivity mode consists of a capacitor 34 and a resistor 35 connected in parallel between one terminal of the switch 17 and ground. The resistor 35 may be variable by the user. The high sensitivity mode consists of another capacitor 36 and resistor 37 connected in parallel between the other terminal of the switch 17 and ground. Alternatively, the high sensitivity mode may be switched into and out of parallel operation with the low sensitivity mode. The capacitors and resistors are selected so that the time constant of the high sensitivity mode will be negligible and the time constant of the low sensitivity mode will provide a smoother decay of the signal. The input terminal of the switch 17 is also connected to the input of the bar graph circuit 38. As shown, the bar graph circuit 38 includes a sequence of ten light emitting diodes 39 coordinated to be automatically incrementally sequentially energized in response to relative incremental sequential variations in the magnitude of the input signal to the bar graph circuit 38. The time delay of the low sensitivity mode is more suitable for long distance driving. The high sensitivity mode is used for aid in detecting misfires, indicating virtually every firing of the spark plugs. It should be used at idle or low engine RPM. There is also provided a level control circuit 40, as shown consisting of resistors 41 and 42, connected to the reference contacts 43 of the bar graph circuit 38 which permit selection of a threshold level of operation of the bar graphs 12, 13, 14 or 15, preferably below the mid level 18 of the bar graphs 12, 13, 14 or 15, when the engine is idling and the ignition system is properly functioning.

As shown in FIG. 3, in a preferred embodiment, the system will include four capacitive clips (not shown) and four knock-down resistor circuits 71, 72, 73 and 74, one for each spark plug. One or more discrete, multiple channel, integrated chips 45 receives the signals from the knock-down resistor circuits 71, 72, 73 and 74 and feeds those signals through four separate diodes 46, 47, 48 and 49, to four timing circuits 51, 52, 53 and 54. The knock down resistor circuits 71, 72, 73 and 74 and the integrated chip 45 and its protection circuits are mounted in a box (not shown) close to the plug ends of the ignition wires. Four wires 55, 56, 57 and 58 run from the box to the console 10 mounted in the vehicle dashboard or display panel. The console 10 contains the timing circuits 51, 52, 53 and 54, the bar graphs 12, 13, 14 and 15 and the bar graph circuits 38 together with the operator test circuit. The operator test circuit consists of four diodes 61, 62, 63 and 64 having their cathodes connected between the diodes 55, 56, 57 and 58 and the timing circuits 51, 52, 53 and 54 of their respective spark plugs and having their anodes commonly connected to one side of a test switch 16. The other side of the test switch 16 is connected to the variable leg of a potentiometer 65 which is itself connected across a biasing voltage V+ to ground.

In operation, as the vehicle engine is running, the intermittent sparking of each plug results in the capacitive clips deriving an intermittent pulse for their respective circuits. The knock-down resistor circuits 71, 72, 73 and 74 reduce the voltage delivered to the chip 45 and to their light emitting diodes 26 and, together with the silicone 27 and geranium 28 diodes, protect the light emitting diodes 26. The photo transistors 30 then produce an operating signal which, being light rather than signal responsive, will somewhat smooth the resulting signal. This signal is further smoothed by the low sensitivity selective time delay circuit prior to delivery to the bar graph circuit 38. Thus, the operation of the bar graphs 12, 13, 14 or 15 is responsive to a relatively smooth signal rather than to the abruptly pulsating signal derived directly from the capacitive clips. Therefore, the operation of the bar graphs 12, 13, 14 and 15 will also be relatively smooth and constant, permitting observation by the operator in a manner conducive to comfortable operator comparison of side-by-side bar graph levels. Variations from normal operation can be readily detected by the operator without the need for undue attention to the display and without irritation and confusion which would result from abrupt responsive variations in the bar graphs 12, 13, 14 and 15. If the user desires to monitor every spark plug misfire, the high sensitivity mode is selected by operation of the switch 17.

The operator may test the bar graphs 12, 13, 14 and 15 at any time by closing the test switch 16, causing the test voltage to be simultaneously applied to all bar graph circuits 38 which, if they are properly functioning, will all light to the same level.

In a preferred embodiment of the invention now used by the inventor, the resistors 22 and 25 employed in the knock down circuits 71 through 74 are 100k and 1k ohms, respectively. The chip 45 consists of two discreet two-channel chips such as Seimans Catalog No. PS2506-2 which includes the protective diodes 27 and 28. The external diodes employed are typically National Semiconductor IN4001 diodes. The switch 17 is a Quad Bilateral Switch, typically National Semi-Conductor Catalog No. CD4066 biased at 12 volts across a 1k ohm resistor. The low sensitivity mode resistor 35 is a 500k ohm variable resistor adjusted to approximately 470k ohms. The low sensitivity mode capacitor 34 is, 0.01 microfarads and the combined high and low sensitivity mode capacitors 34 and 36 are 2.21 microfarads. The bar graph circuit 38 including the bar graphs 12, 13, 14 and 15 illustrated in FIG. 1 are Three Five Company Catalog No. TSM 3934. When using this bar graph it is desirable to connect a 100 ohm resistor 44 between its pin No. 3 and its bias voltage. The level control circuit resistors 41 and 42 are 2.2k and 4.7k ohms, respectively. The resistors 65 and 66 of the test circuit are 5k and 1k ohms respectively.

It should be noted that many variations in this system are possible. For example, an inductive pick up can be employed rather than capacitive clips to derive the signal from the ignition wires, although the capacitive clip is preferred for its simplicity and economics. Also, the gain control circuit associated with each bar graph may be externally varied when the engine is idling to permit the operator to establish the bar graph levels at a low level preferred by the operator.

While the invention has been described in relation to a four cylinder engine, it will be obvious that this system can be employed with any number of cylinders. A bar graph circuit is required for each cylinder of the internal combustion engine and any number of multiples of the circuit can be employed to accommodate any number of cylinders.

While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. On board apparatus for visually indicating efficiency of a spark plug of an internal combustion engine comprising:

means for deriving a current from the distributor wire serving the spark plug;

means for optically converting said derived current into an analog signal substantially proportionately responsive to said derived current over the full range of the derived current pulse amplitude, said converting means having low sensitivity means for averaging said analog signal into a comparatively smooth signal, high sensitivity means for averaging said analog signal into a signal comparatively closely corresponding to said derived current and means for selectively applying said low sensitivity means or said high sensitivity means to said analog signal; and means for automatically incrementally sequentially varying visible indicia in response to relative incremental sequential variations in the magnitude of said analog signal.

* * * * *